US006478068B1

(12) United States Patent
Brown

(10) Patent No.: US 6,478,068 B1
(45) Date of Patent: Nov. 12, 2002

(54) EDGE TAPING TOOL

(75) Inventor: J. Paul Brown, Holiday Island, AR (US)

(73) Assignee: Cambridge, Ltd., Holiday Island, AR (US)

( * ) Notice: Subject to any disclaimer, the term of this patent is extended or adjusted under 35 U.S.C. 154(b) by 36 days.

(21) Appl. No.: 09/747,756

(22) Filed: Dec. 21, 2000

(51) Int. Cl.[7] ..... B32B 31/00
(52) U.S. Cl. ..... 156/577; 156/579; 225/51
(58) Field of Search ..... 156/574, 577, 156/579; 225/51

(56) References Cited

U.S. PATENT DOCUMENTS

| | | | | | |
|---|---|---|---|---|---|
| 1,257,009 | A | * | 2/1918 | MacLaurin | 156/526 |
| 2,533,209 | A | * | 12/1950 | Ames | 104/119 |
| 3,829,347 | A | * | 8/1974 | Honea | 156/481 |
| 3,871,940 | A | | 3/1975 | Antonioni | |
| 3,900,362 | A | | 8/1975 | Schaffer | |
| 4,406,730 | A | | 9/1983 | Altmix | |
| 4,608,116 | A | | 8/1986 | Braselton | |
| 4,623,421 | A | | 11/1986 | Cardin | |
| 5,174,850 | A | | 12/1992 | Stefan | |
| 5,269,871 | A | | 12/1993 | Longworth et al. | |
| 5,456,422 | A | | 10/1995 | Longworth | |
| 5,562,262 | A | | 10/1996 | Pennell | |
| 5,641,378 | A | | 6/1997 | Luhman et al. | |
| 5,791,586 | A | | 8/1998 | Cayford et al. | |
| 5,800,668 | A | * | 9/1998 | Bumb | 156/523 |
| 5,865,943 | A | | 2/1999 | Marty | |
| 5,954,916 | A | * | 9/1999 | Orlandi | 156/385 |
| 5,968,311 | A | * | 10/1999 | Zupon et al. | 156/574 |
| 5,971,453 | A | * | 10/1999 | Schlisner | 156/579 |

* cited by examiner

*Primary Examiner*—Mark A. Osele
(74) *Attorney, Agent, or Firm*—Fellers, Snider, Blankenship, Bailey & Tippens, P.C.

(57) ABSTRACT

There is provided herein a new apparatus for applying tape such as masking tape to surfaces for purposes of protecting those surfaces from exposure to subsequent treatment of adjacent surfaces by paint, varnish, stain, and the like. The device of the instant invention includes a rotably mounted spool of tape which is fed past a cutter blade, over a guide pin and around an application roller. The cutter blade is positioned to be clear of the tape during normal operation. However, when the tape is tensioned by braking the rotation of the tape spool by application of a hand brake, the tape path is drawn down into contact with the blade, thereby severing it. Additionally, the instant invention utilizes a plurality of guide wheels to space the tape that is deposited by the instant invention apart from the surface that is adjacent to the taped one.

19 Claims, 9 Drawing Sheets

5
5
170
120
130
705
230
240
160
200
240
180
150
240
165
135
175
125

230
200
150
705
165
175
315
125
180
135

EDGE TAPING TOOL

EDGE TAPING TOOL

The present invention relates to the general subject matter of building construction and remodeling, and more particularly, to methods and apparatus for applying pressure adhesive tape, such as masking tape, to a flat surface to prepare it for painting and the like.

BACKGROUND OF THE INVENTION

The problem of applying tape to a planar surface is an old one that has seen many proposed solutions within the building construction arts. As is well known in this industry, it is often necessary to apply pressure sensitive adhesive tape from a roll onto a surface such as a wall, trim, molding, ledge, or other surface. This might be done for any number of reasons, but among the most common would be to cover one surface in order to protect it when paint (sealant, etc.) is applied via spray or brush to an adjacent surface.

Of course, the simplest (and oldest / most direct) solution is simply to grasp the roll and manually feed the tape onto the recipient surface while letting the tape unroll. This approach is obviously inexpensive (in that it requires no expenditure on equipment) but is potentially inefficient and labor intensive, may not lay down the tape accurately, and is ill suited where the project requires the application of substantial amounts of tape over long runs.

As a general matter, the prior art contains many examples of devices that have been designed to improve this process by automatically feeding the tape from the roll onto the taped surface. In the construction arts, numerous hand-operated devices have been developed that are adapted for use with a supply roll of masking tape and that apply the tape to surfaces such as along the top edges of baseboards, along door frames, and the like that are disposed at about right angles to closely adjacent wall surfaces. Typically, these devices are intended to be manually grasped and moved along a surface, the tape being dispensed from a rotably mounted spool and guided onto the taped surface by one or more application rollers that keep the tape tensioned and apply pressure to it to affix it to the surface.

Examples of such prior art devices might be found in U.S. Pat. Nos. 3,900,362, 5,269,871, 5,456,422, and many others. However, a problem which none of the prior art devices have addressed is how to maintain the taping apparatus at a predetermined distance from an adjacent surface while simultaneously protecting the adjacent surface from abrasion by the taping unit. Further the prior art has not yet satisfactorily solved the problem of severing the tape when the end of the run is reached. Prior art devices have typically implemented this function by requiring the dispenser operator to remove one hand or the other form the device in order to manually actuate a cutting blade. Alternatively, other inventors have provided a means for severing the tape that requires the operator to manipulate the entire dispenser to bring the tape into contact with a cutter, thereby potentially causing the device to come into contact with (and mar) the adjacent surface.

Of particular interest for purposes of the instant invention is U.S. Pat. No. 3,871,940, which names Antonioni as inventor. The device taught in this patent provides a hand-held tape dispenser that automatically dispenses tape when it is pushed or pulled along a planar surface. This tape dispenser includes spacing wheels at the upper periphery of its frame, the purpose of the spacing wheels being to prevent the roll of tape from contacting the adjacent surface while the device is being operated. However, this device does not address the general problem of how to prevent contact of the tape dispensing rollers with the adjacent surface during operation, nor does it allow the user to adjust the gap between the adjacent surface and the tape that is deposited by the invention taught therein. Finally, this device is not designed to maintain level and uniform pressure against the surface being masked.

Heretofore, as is well known in the construction and painting arts, there has been a need for an invention to address and solve the above-described problems. Accordingly, it should now be recognized, as was recognized by the present inventor, that there exists, and has existed for some time, a very real need for a device that would address and solve the above-described problems.

Before proceeding to a description of the present invention, however, it should be noted and remembered that the description of the invention which follows, together with the accompanying drawings, should not be construed as limiting the invention to the examples (or preferred embodiments) shown and described. This is so because those skilled in the art to which the invention pertains will be able to devise other forms of this invention within the ambit of the appended claims.

SUMMARY OF THE INVENTION

There is provided hereinafter a new apparatus for applying tape such as masking tape to surfaces for purposes of protecting those surfaces from exposure to subsequent treatment of adjacent surfaces by paint, varnish, stain, and the like.

In more particular, the device of the instant invention includes a rotably mounted spool of tape which is fed past a cutter blade, over a guide pin and around a first application roller. The cutter blade is positioned to be clear of the tape during normal operation. However, when the tape is tensioned as described hereinafter, it is drawn down into contact with the blade, thereby severing it.

The worker operates the instant invention by placing the adhesive side of the tape in contact with the surface to be taped. After the leading edge of the tape has adhered, forward motion of the instant device causes the tape to tensioned and unwound from the roll. Pulling or pushing the device forward causes the tape to be unwound from the spool, as the terminus is fixed to the taped surface and pulls against the spool.

As the worker reaches the end of the run—and preferably while the device is still moving forward—a reel brake that is preferably located on the handle is activated. The brake retards or stops rotation of the tape spool. The retarding force—in combination with continued forward motion of the device—increases the tension in the tape and causes the take-off point of the tape to move downward, thereby drawing the tape path downward and onto the cutting blade. This allows the tape to be severed in one clean motion.

According to another preferred embodiment of the instant invention, there is provided a device substantially as described above, but wherein it further utilizes a tape-end retainer to hold the terminus of the adhesive tape in place. In more particular, the instant inventor has provided a means by which the terminus of the adhesive tape may be held after the tape has been threaded through the instant device. This embodiment is designed to hold the tape in place while the taping tool is maneuvered in preparation for the start of a taping run.

The foregoing has outlined in broad terms the more important features of the invention disclosed herein so that the detailed description that follows may be more clearly understood, and so that the contribution of the instant inventor to the art may be better appreciated. The instant invention is not to be limited in its application to the details of the construction and to the arrangements of the components set forth in the following description or illustrated in the drawings. Rather, the invention is capable of other embodiments and of being practiced and carried out in various other ways not specifically enumerated herein. Additionally, the disclosure that follows is intended to cover all alternatives, modifications and equivalents as may be included within the spirit and scope of the invention as defined by the appended claims. Further, it should be understood that the phraseology and terminology employed herein are for the purpose of description and should not be regarded as limiting, unless the specification specifically so limits the invention. Further objects, features, and advantages of the present invention will be apparent upon examining the accompanying drawings and upon reading the following description of the preferred embodiments.

DETAILED DESCRIPTION OF THE PREFERRED EMBODIMENTS

According to a preferred aspect of the instant invention, there is provided a new apparatus and method for applying tape, such as masking tape, from a roll onto a wall or other surface as a preparatory step to painting, staining, etc., which provides a mechanism for protecting and spacing the laid tape apart from the adjacent surface. It additionally features a novel means of cutting the tape when the end of a run is reached.

Figure 1:
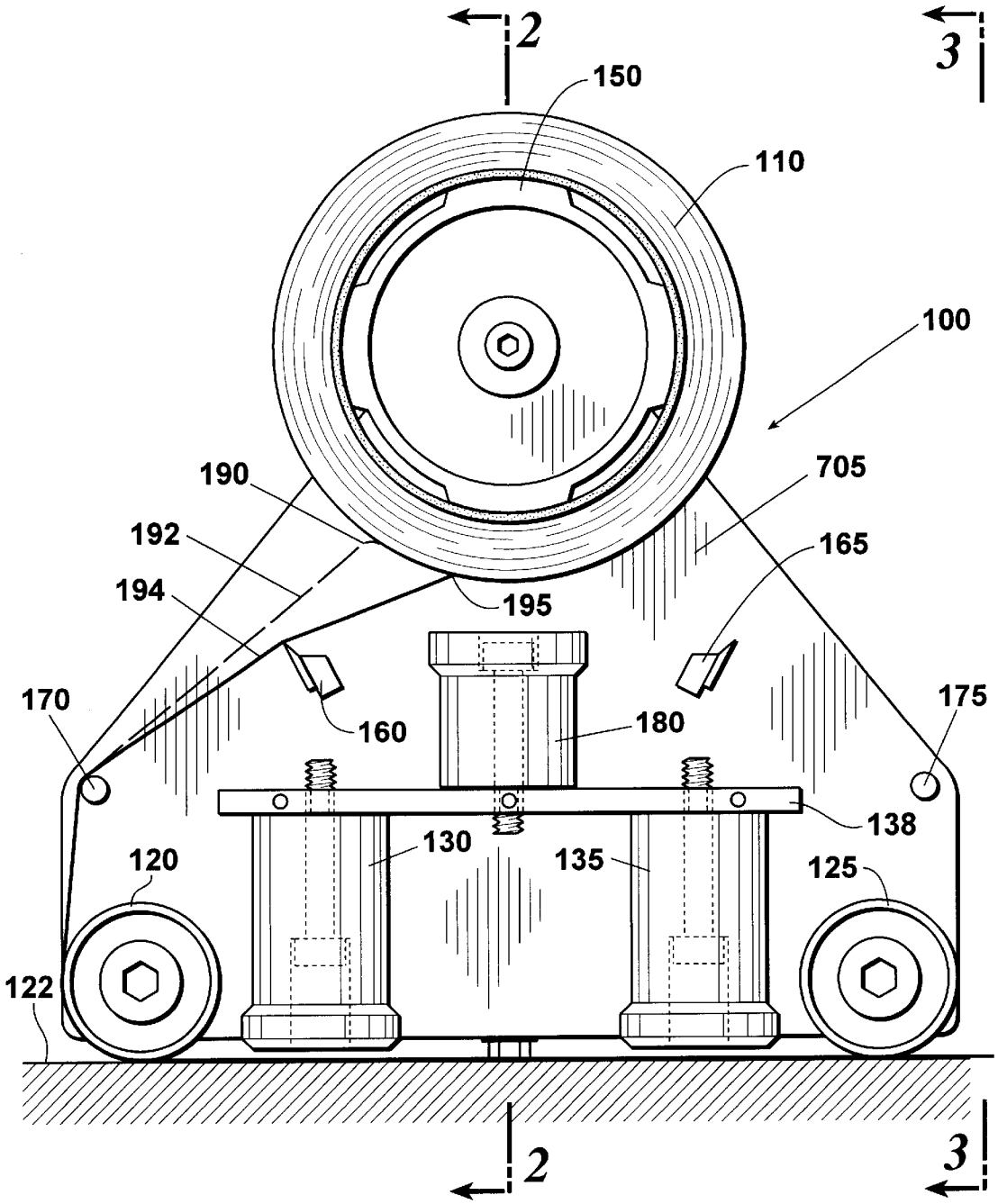
FIG. 1 contains a front view of a preferred embodiment of the instant invention.

As is generally illustrated in FIG. 1, the front or operational side of a preferred embodiment of the instant invention 100 is made to be symmetric about center line 2—2 so that this device 100 may be operated to dispense tape in either direction. That is, the embodiment of FIG. 1 is loaded so as to dispense and apply tape by moving the instant device 100 to the reader's left. According to a preferred aspect of the invention, by reversing the orientation of the tape spool 110 on the reel 150 (and by creating a tape path over pin 175 and around roller 125) the instant invention 100 can be made to operate in the reverse (reader's right) direction. Those of ordinary skill in the art will recognize that it might be desirable to allow for operation in both directions for any number of reasons including, for example, to accommodate taping tasks that are more suited to application of tape in one movement direction than another, or to allow left and right handed users to customize the tape dispensing unit 100 to suit their own taste. However, this sort of symmetric configuration is offered purely for the convenience of the operator and not an essential aspect of the instant invention.

Figure 3:
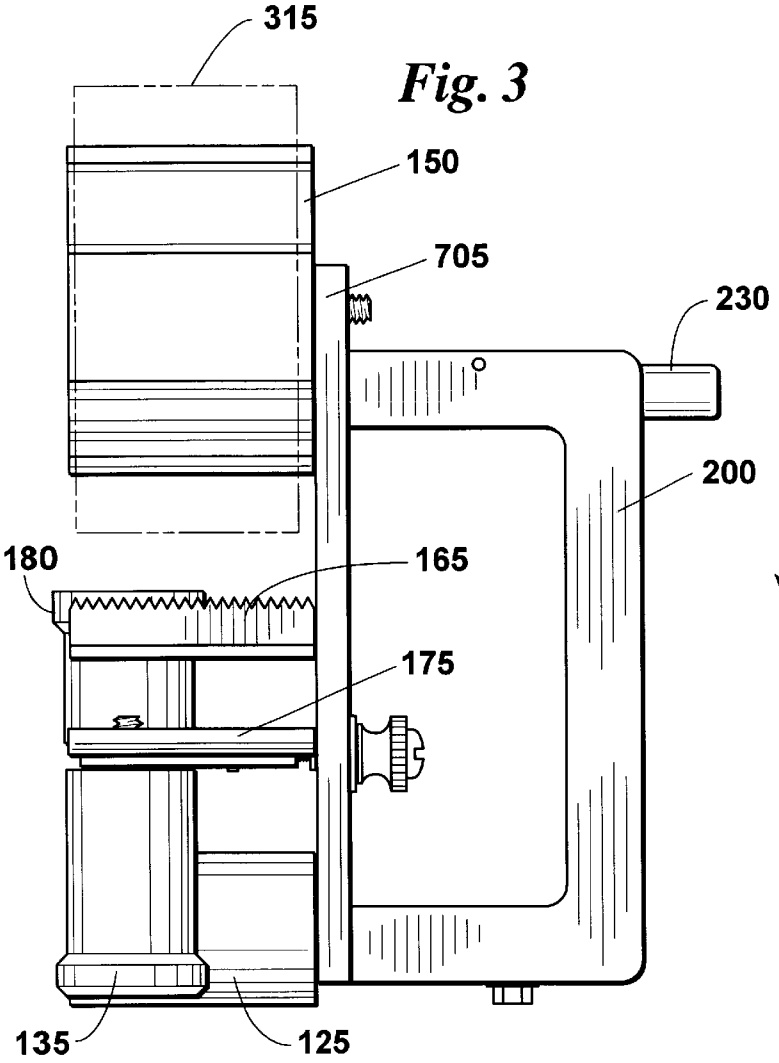
FIG. 3 contains a profile view of a preferred aspect of the instant invention, wherein a wider roll of tape has been placed on the tape reel.

The preferred embodiment of the instant invention taping tool 100 is sized to accommodate a standard roll of masking tape 110 on tape reel 150. As is well known to those in the construction arts, masking tape is available in a variety of widths (see, for example, the wider roll 315 shown in phantom in FIG. 3) and the instant invention is designed to accommodate a wide ranges of popular widths. Additionally, tape reel 150 is diametrically sized to accommodate tape 110 that is of a standard diameter, although clearly that part could be made to be interchangeable or adjustable to allow for the invention's use with tapes of different internal diameter.

Additionally, it should be noted that although the tape reel 150 of the instant invention is illustrated as being near the upper periphery of the taping tool 100, that is not a requirement and those skilled in the art are capable of modifying the instant invention to position the tape reel 150 elsewhere.

The tape 110 is threaded with the adhesive surface facing outward (i.e., facing to the left in FIG. 1) over left guide pin 170 around left application roller 120 and across the bottom of the unit 100 (adhesive surface down) where it can make contact with the surface 122 to which the tape will be applied. Optionally, the tape may be further passed under and around right application roller 125 to be affixed at its terminus to right pin 175 by applying the adhesive face of the tape 110 to that element. The application of the tape 110 to the right pin 165 provides a convenient way to temporarily secure the tape 110 in place while the roller is being positioned by the workman. Note that although the preferred arrangement is for the guide pin to be a stationary cylindrical plastic or metal rod, those skilled in the art will recognize that many alternative arrangements are possible including the use of a rollers, planes, etc. Thus, in the text that follows the term "pin" should be construed broadly to include any device or structure capable of guiding the tape between the tape roll 110 and the application roller 120.

One critical aspect of the instant invention 100 is the utilization of guide rollers 130, 135, and, 180 (best illustrated in FIGS. 1, 2, and 7) to space the instant device apart from the surface 222 that is adjacent to the taped surface 122. The guide rollers are preferably made of a smoothed molded and resilient material such as plastic, so that they do not scratch or otherwise mar the adjacent surface during operation of the instant taping unit 100. That being said, plastic is only a preferred material of choice and one of ordinary skill in the art will recognize that many other materials could be substituted therefore.

Figure 2:
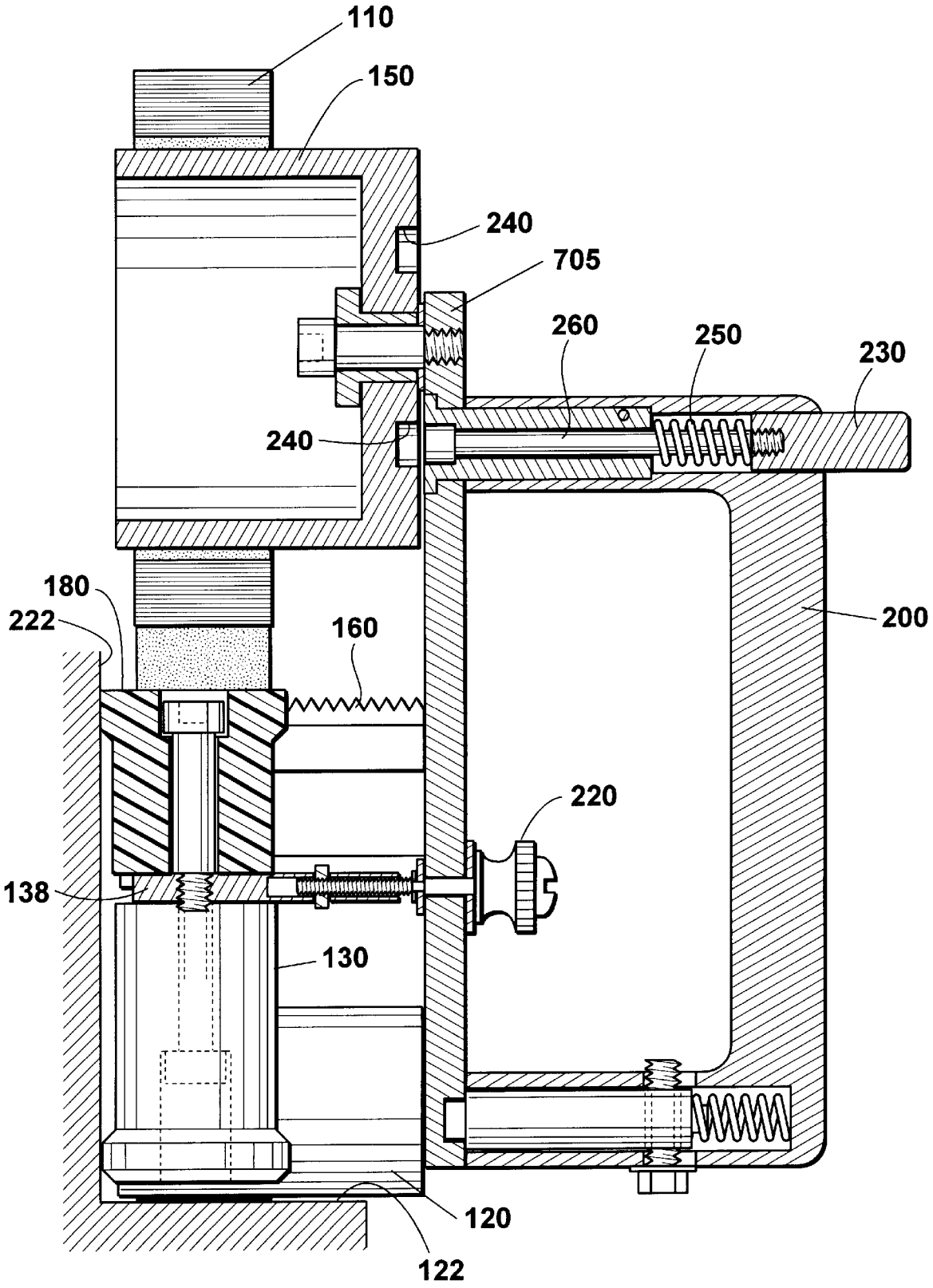
FIG. 2 illustrates a cross sectional view of the instant invention with the reel brake unengaged.
Figure 4:
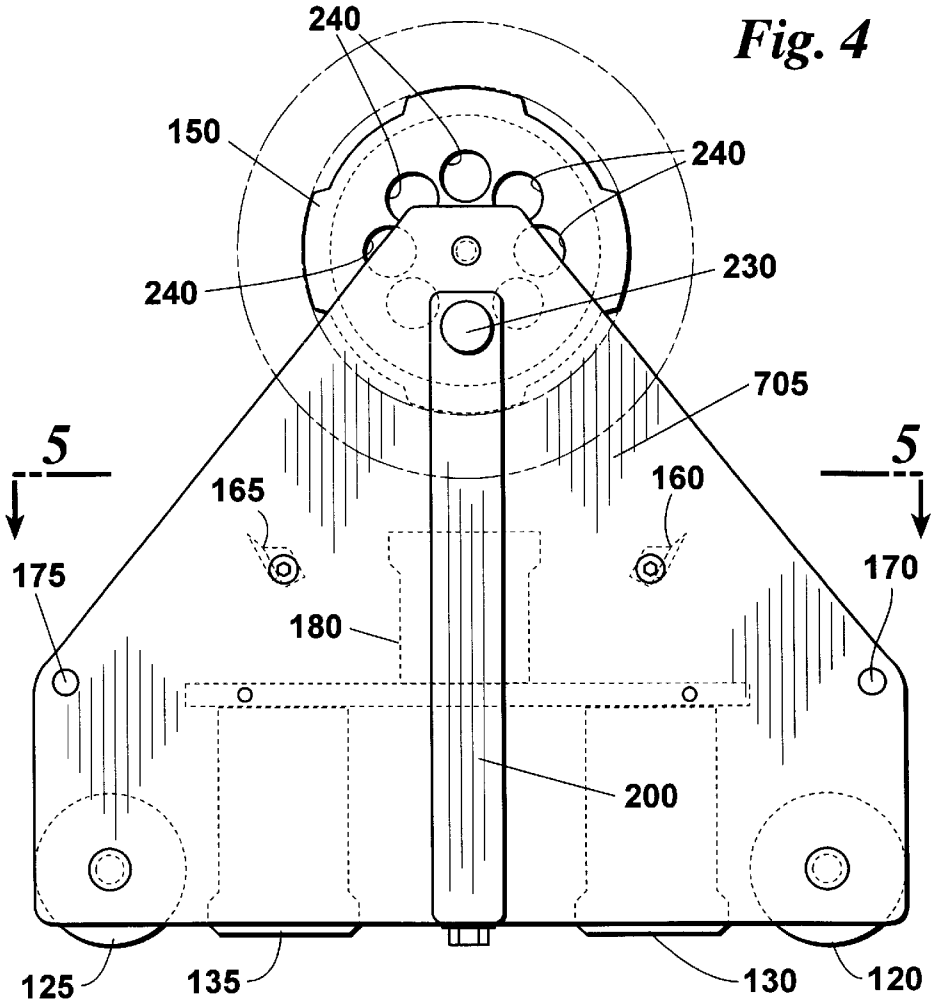
FIG. 4 shows a rear view of a preferred embodiment of the instant invention.

In the preferred embodiment, the guide rollers are oriented transversely with respect to the application rollers 120 and 125 and are positioned so as to keep the outermost termini of those rollers from contacting the surface 222 which is proximate to the surface 122 that is being taped (FIG. 2). Said another way, in a typical application (e.g., masking a wall surface that abuts a ceiling that is to be painted) the guide rollers roll along in contact with the ceiling, thereby keeping the termini of the application rollers 120 and 125 from marring the ceiling during application of the tape 110. This necessarily means that the guide rollers must extend beyond the outermost limits of the application rollers.

Additionally, it is critical that the guide rollers fully support the entire device 100 away from the adjacent surface 222. Thus, the only point of contact between the taping unit 100 and the wall is via the guide rollers 130, 135, and, 180. As a consequence, these rollers must be configured so as to provide a stable support for the taping unit 100 when it is pressed up against the adjacent surface 222 during a taping operation. Needless to say, the precise number of rollers and their location on the front face of this device 100 is not a critical aspect of the invention as taught herein, except that they must fully support it away from the adjacent wall 222. Although the preferred embodiment of the instant invention utilizes three guide rollers, it should be clear that the precise number of guide rollers is unimportant, except that there must be at least two such rollers to provide the stability necessary for reliable operation. Those skilled in the art will be able to devise many arrangements of the guide rollers to satisfy this object of the invention.

Additionally, the position of the guide rollers with respect to the body of the instant invention 100 is preferably made to be adjustable so that the amount by which those rollers extend beyond the end of application rollers 120 and 135 can be varied according to the needs of the particular job. Adjustment in the outward position of the guide rollers will have the effect of moving the tape reel 150 and the tape that is deposited thereby closer to (or further away from) the adjacent surface 222. Thus, the user is given control over the spacing between the laid tape and the adjacent surface though this mechanism. This ability is extremely important to the operator performing "backfilling" as that term is known and used in the painting and construction industries.

As is best illustrated FIGS. 2, 5, 6 and 7, the guide rollers are preferably supported by a single planar surface—mounting plate 138—that is adjustably connected to the front face of edge taping tool 100. In the preferred embodiment, support pins 710 and 715 in combination with knurled head screw 220 are used to position the mounting plate 138 and guide rollers toward and away from the front face of plate 705. As can be seen by comparing FIGS. 2 and 6, when knurled head screw 220 is rotated it moves the planar surface 138 by way of its threadable connection thereto. This movement is transferred to guide rollers, thereby causing the tape to be deposited closer to (FIG. 6) or further away from (FIG. 2) the adjacent surface 222.

Figure 7:
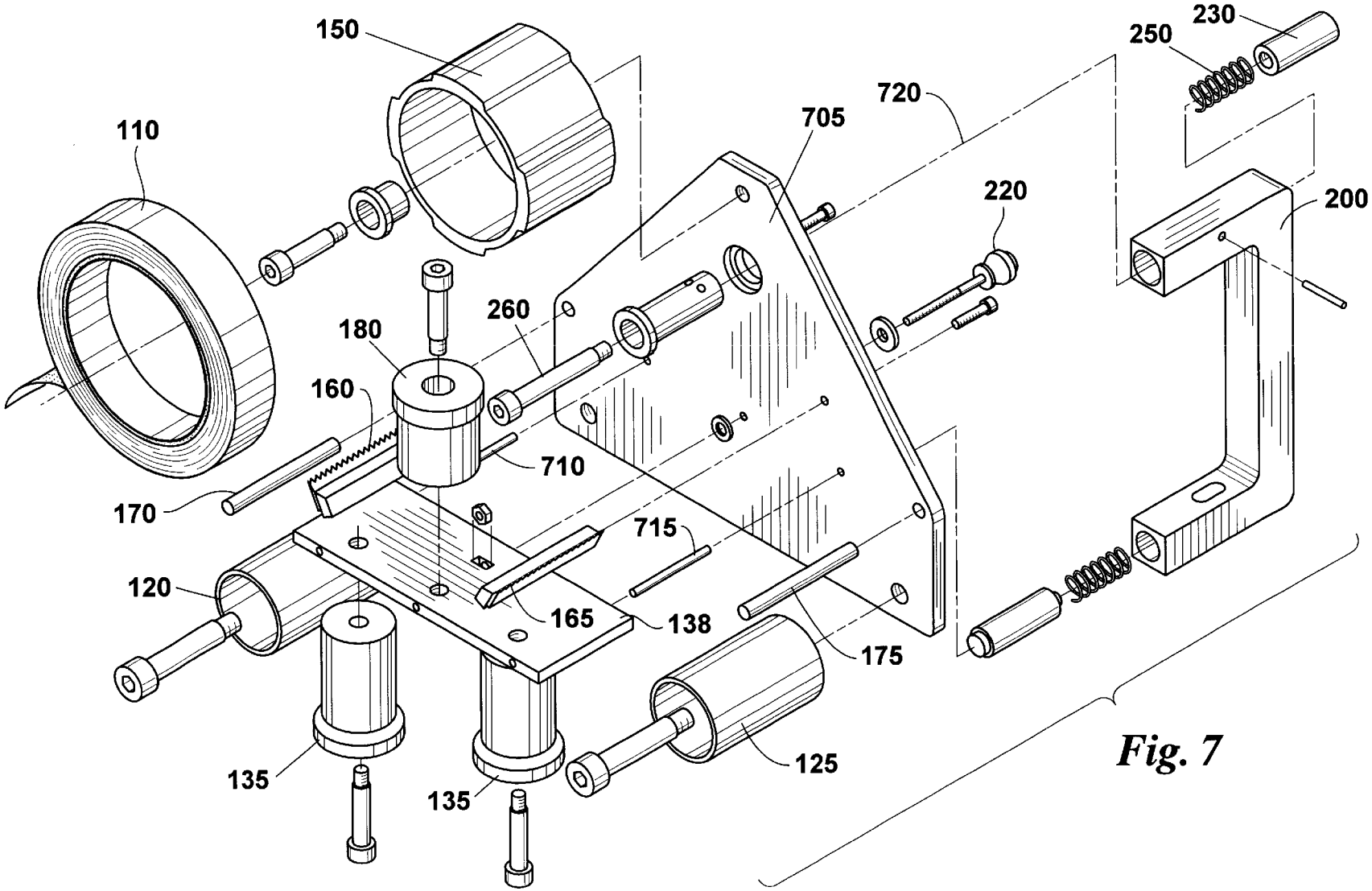
FIG. 7 contains an exploded view of a preferred embodiment of the instant invention.
Figure 8:
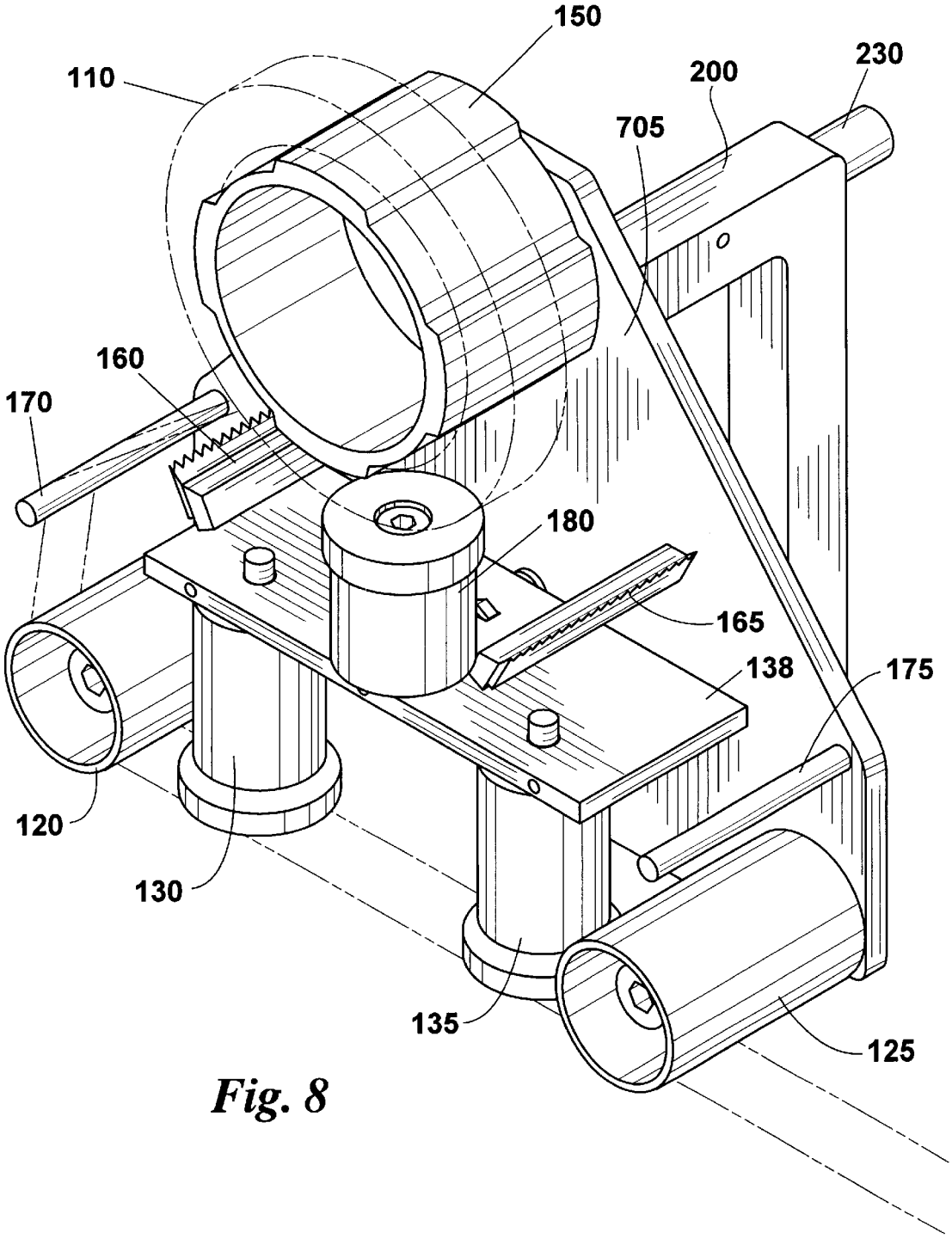
FIG. 8 is a perspective view of a preferred embodiment of the instant invention.

As an optional aid in the utilization of the instant device, handle 200 has been provided on the rear of plate 705 (FIGS. 2, 3, 4, and 7). Preferably, the handle 200 will be rotably attached to the instant invention so that it can be positioned at a variety of angles with respect to the vertical axis. As is best illustrated in FIG. 7, in the preferred embodiment the handle 200 will rotate about axis 720 so that the user can position it as desired for comfort or necessity.

Figure 5:
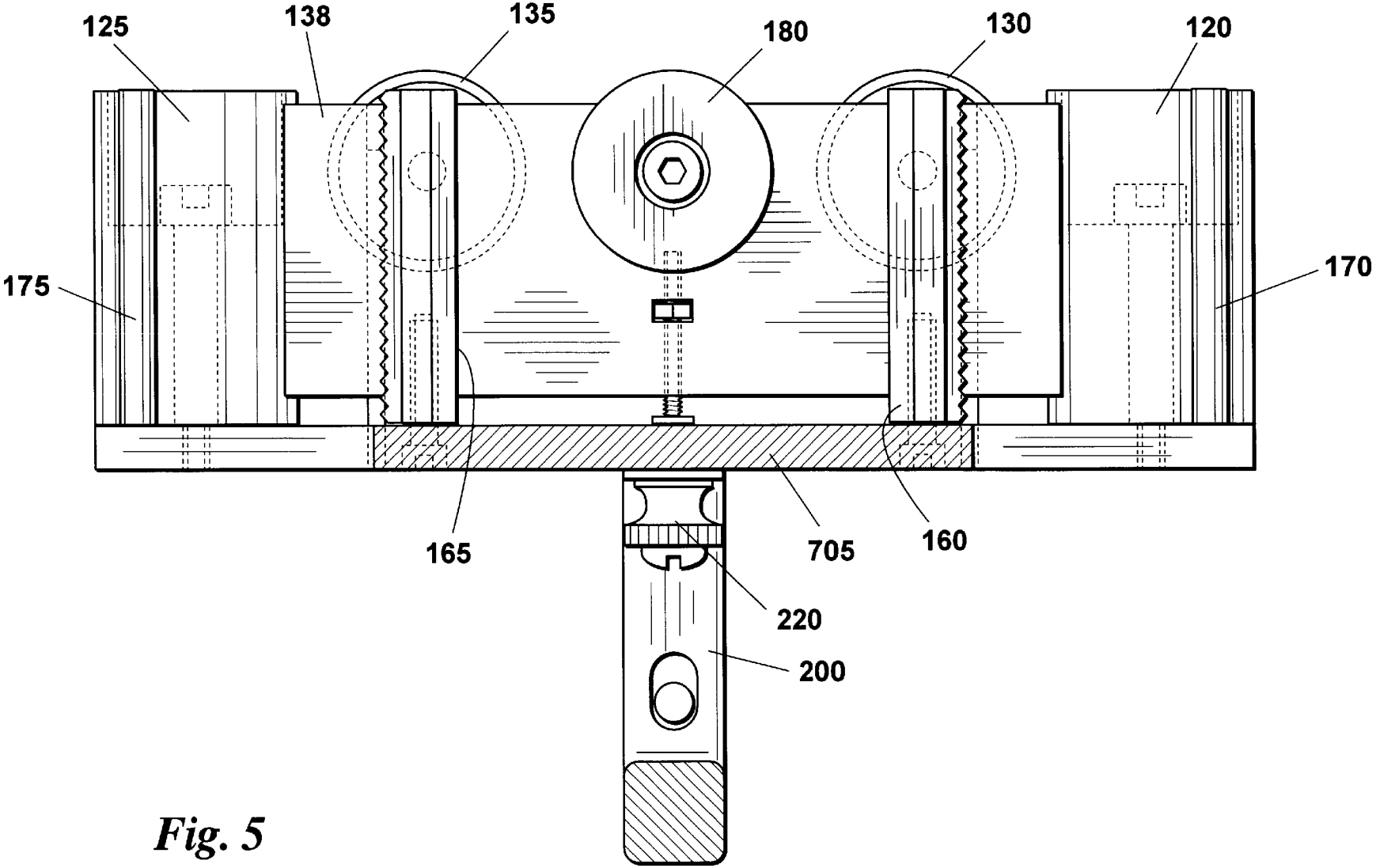
FIG. 5 contains a downward looking cross sectional view of a preferred embodiment of the instant invention.
Figure 6:
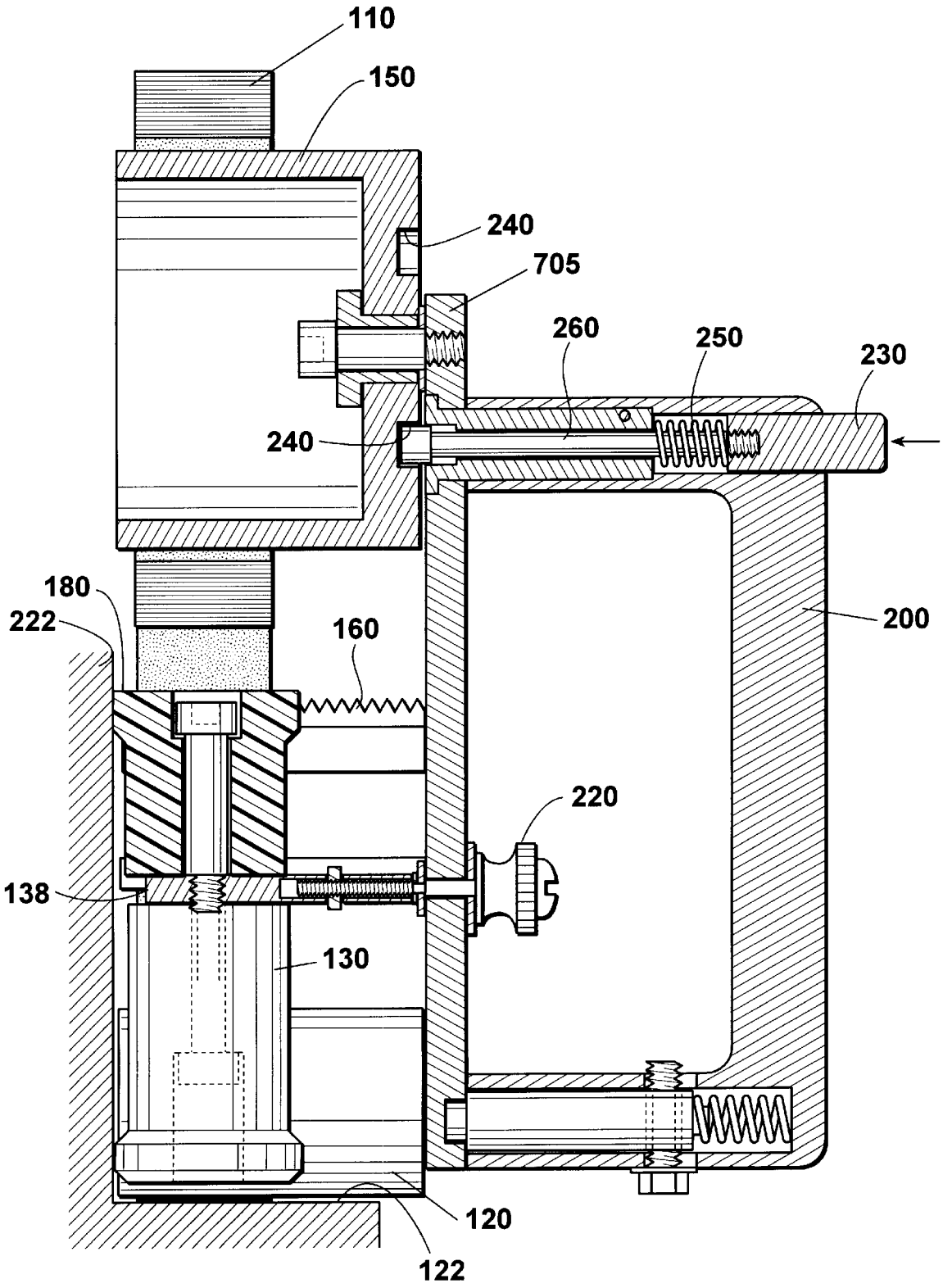
FIG. 6 illustrates a preferred embodiment wherein the thumb lock has been actuated and wherein the position of the guide rollers has been adjusted so that tape is deposited closer to the adjacent surface.

Another novel feature of the instant invention is the inclusion of a mechanism to brake the rotation of the tape reel 150, the importance of which will be discussed hereafter. As is best illustrated in FIGS. 2, 5, and 7, in the preferred embodiment the rearward face of the tape reel 150 will have at least one indentation 240 placed therein. The purpose of the indentation 240 is to provide a resting place for the forward terminus of braking rod 260, which when fully extended will engage one of the indentations 240, thereby stopping the rotation of the tape reel 150. In the preferred embodiment, the braking rod 260 will urged forward by pressure on actuator thumb lock 230 and is restored to back to its non-engaged position by action of spring 250. Note that "indentation" should be broadly construed to include apertures that pass completely through the rearward face of the tape reel 150. More generally, the method of engaging and retarding the rotation of the tape reel 150 could be frictional, with the terminus of braking rod 260 frictionally engaging the rearward portion of the tape reel 150 to slow or stop its rotation. For purposes of specificity in the text that follows, the term "frictionally engages" will be used in its broadest sense to include traditional frictional braking mechanisms, as well as positive engagement as illustrated in the preferred embodiment.

Needless to say, the instant braking mechanism is only one of many that might be devised by one of ordinary skill in the art. The precise means by which the braking mechanism retards the rotation of the tape reel 150 is unimportant. However, for reasons described hereinafter it is preferable that when the reel brake mechanism is engaged it completely thwarts further rotation of the tape reel 150, rather than merely retarding or slowing it.

Another unique feature of the instant invention 100 is the positioning and functionality of the cutting blade 160 (and its counterpart on the right half of the unit 165). The uppermost terminus of the cutter 160 is sharpened as might be expected. (This is most easily seen in FIG. 2). As is shown in FIG. 1, the cutter is positioned adjacent to the path of the masking tape 110. When tape is extracted from the device 100 during a taping maneuver, the instant invention 100 is dimensioned so that the tape path 192 is away from the blade 160 as the tape is continuously fed onto the wall or other taped surface.

However, when the end of the tape run is reached and it is desired to cut the tape, the cutting is accomplished by the simply engaging the reel brake mechanism and continuing to move the taping tool 100 forward (i.e., to the reader's left in FIG. 1). Continued forward movement of the taping tool 100 while the rotation of the tape reel 150 is retarded will have the effect of increasing the tension in the tape, thereby moving the unimpeded take-off point 190 of the tape counterclockwise to take-off point 195. This movement will have the effect of relocating the unimpeded tape travel path 192 to position 194, thereby causing the tape to engage the cutter 160 and sever the tape. The device can now be re-threaded and prepared for use in taping another surface.

In summary, during normal operations the tape unit 100 is threaded as described previously and placed with the adhesive surface of the tape 110 in contact with the surface that is to be masked: the applications rollers 120 and 125 are placed against the surface to be taped and the guide rollers 130, 135, and 180 are placed against the adjacent wall 222 (if there is one). The operator then seizes the unit by its rear surface handle 210 (FIG. 2) and rolls the guide rollers against the adjacent surface 222, thereby causing the tape 110 to be fed onto the taped surface 122 as the unit 100 is moved. As should be clear, the adhesive side of the tape 110 becomes affixed to the taped surface and, as the instant tape dispenser 100 is moved forward, the ribbon of tape pulls against the roll, thereby rotating it.

As should be clear from a study of FIG. 1, it would be a convenience to the user to provide some further means to secure the end of the tape after it has been positioned beneath the applications rollers 120 and 125. Otherwise, the tape terminus would tend to dangle from the instant invention 100 and could easily become entangled or affixed to other surfaces while the instant device is being maneuvered. Although any number of accommodations might be made to hold the tape in place (e.g., a simple clip or pin arrangement), the instant inventor has developed a preferred apparatus for severing and holding the tape.

Figure 9:
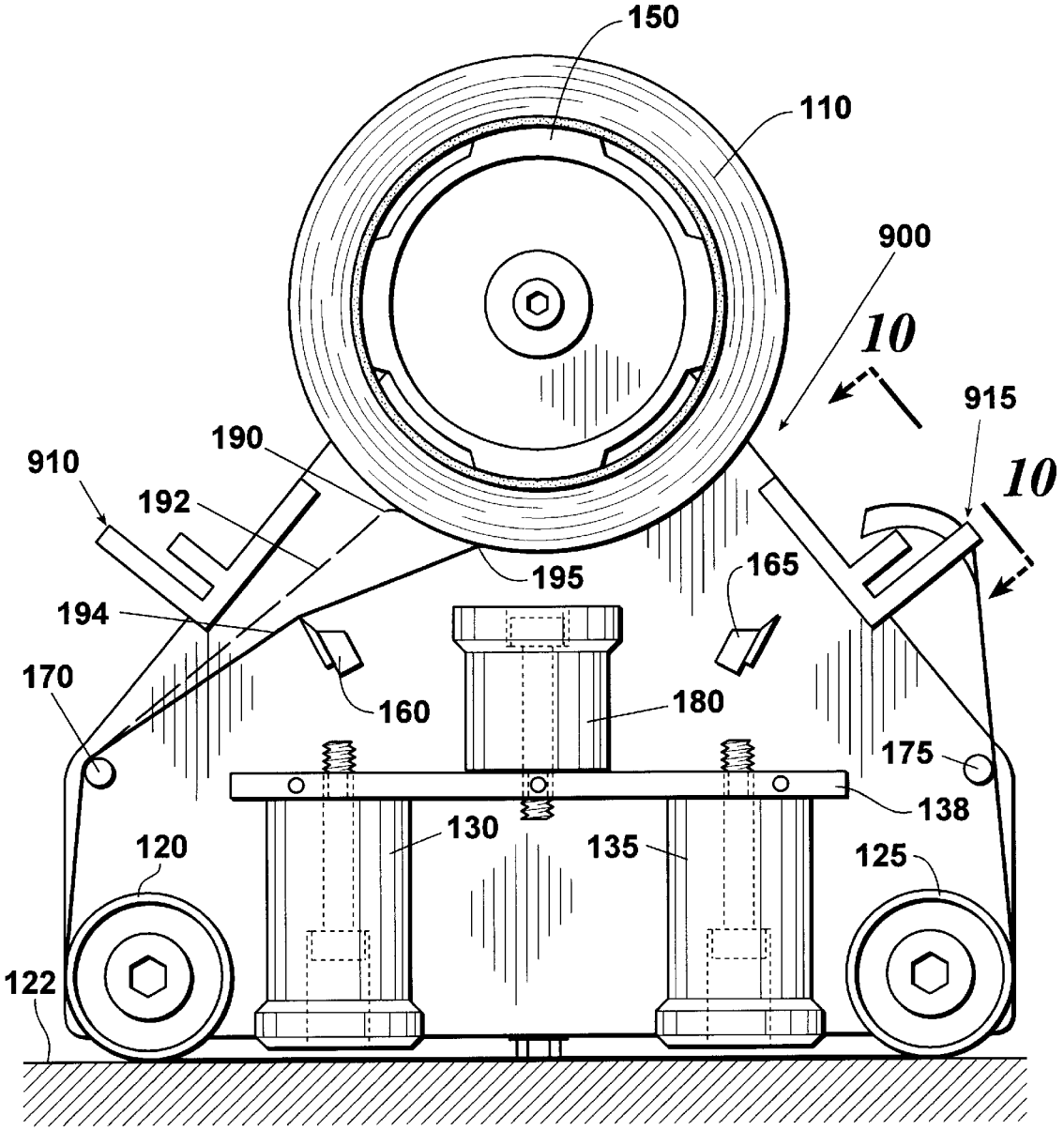
FIG. 9 is a view of another preferred embodiment which further utilizes a tape-end holder.
Figure 10:
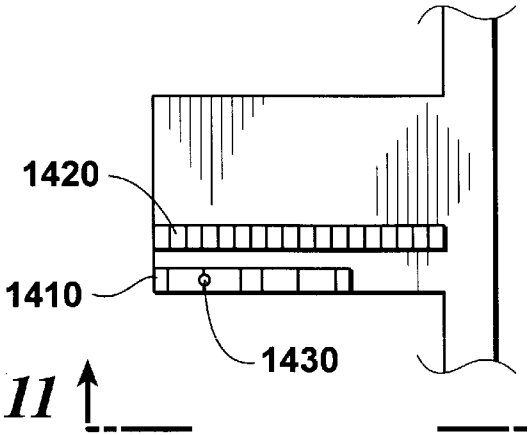
FIG. 10 is a plan view of a preferred embodiment of the tape-end holder of the instant invention.
Figure 11:
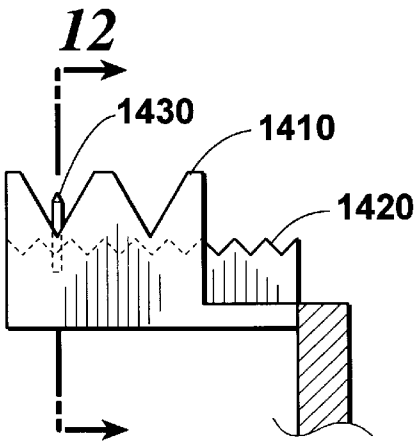
FIG. 11 is a front view of a preferred tape-end holder of the instant invention.
Figure 12:
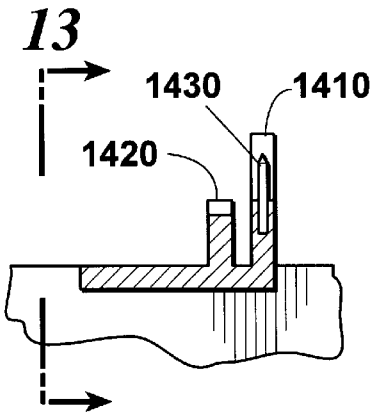
FIG. 12 is a side view of a preferred tape-end holder of the instant invention.

According to another aspect of the instant invention and as is best illustrated in FIGS. 9 through 14, there is provided a tape-end holder/cutter 910 which is designed to expedite the process of readying the instant invention to apply another strip of tape. As is best illustrated in FIG. 9, the instant embodiment 900 is substantially similar to the previous embodiments with the addition of tape securing features 910 (left) and 915 (right). As can be seen in this figure, the general purpose of tape-end holders 910 and 915 are to accept and hold the terminus of tape 110 in place while the instant device is being positioned to begin another run of tape. Tape-end holder 915 is designed for use when the tape is threaded for operation in the direction of the reader's left.

Figure 14:
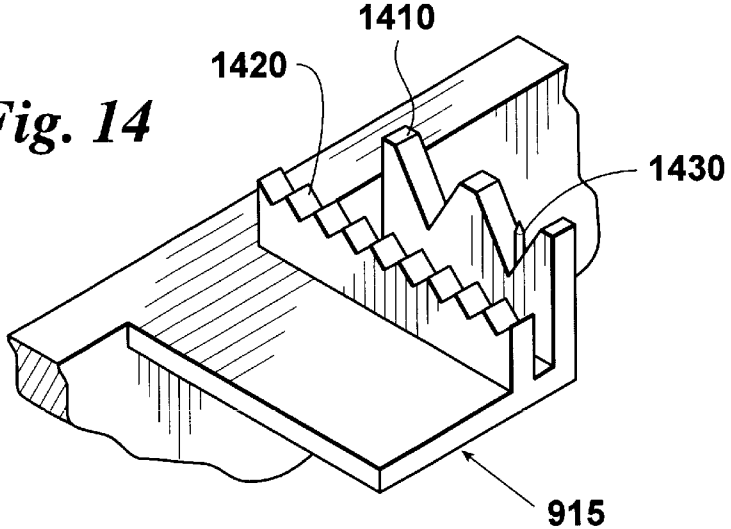
FIG. 14 is a perspective view of a preferred tape-end holder of the instant invention.
Figure 13:
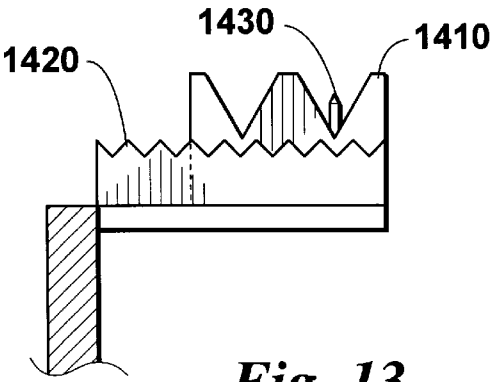
FIG. 13 is a rear view of a preferred tape-end holder of the instant invention.

As can be seen most clearly in FIG. 14, broadly speaking the instant tape-end holder 910 consists of two components: a lower (forward) receiving preferably notched member 1410 and an upper (rearward) cutting member 1420, where "forward" and "rearward" are defined with respect to the tape path, with "rearward" being closer to the terminus of the tape ribbon. In operation, the user threads the tape past pin 170 around application rollers 120 and 125, with the excess tape being brought into contact with tape-end holder 915 to sever and hold it.

As can be seen in FIG. 14, one notch of forward notched member 1410 contains a pin 1430 at its lower extent, which pin 1430 is preferably tapered to a point at its uppermost terminus. The purpose of this pin is to penetrate and hold the tape in place after it has been cut by cutting member 1420. That is, in operation the user will draw the tape down over notched member 1430 and into the notch containing pin 1430 when the tape is brought to bear against cutting member 1420. The pressure exerted by the user in severing the tape ribbon will also cause the pin 1430 to pierce and engage the tape, thereby holding it in place. In the preferred embodiment, the pin 1430 will be made of a material such as steel, but there are many other metals, plastics, etc., that could be used in the alternative. Additionally, in the preferred embodiment only a single piercing pin 1430 will be utilized. However, those skilled in the art will recognize that additional pins 1430 could be added, for example one could be placed in each notch.

Note that the cutting member 1420 need not be made "sharp", but instead it need only provide an edge of some sort against which to tear the tape. Thus, the instant cutting member 1420 should be broadly understood to be any structure that is capable of severing tape such as masking tape.

Finally, it should be noted that the "notch" in notched member 1410 is actually optional, and has been provided to help protect the user against contact with the piercing pin 1430 and to guide the tape down onto it. It should be clear that it is possible that one or more piercing pins 1430 might be mounted at any point in advance of the cutting member 1420, with or without an associated notched member. Thus, in the text and claims hereinafter, the term "receiving member" will be broadly used to describe any sort surface that the piercing pin 1430 might be mounted on, including a flat surface.

Once the tape has been cut and held by tape-end holder 915, the instant device is ready to be positioned for operation. Preferably, the user will begin applying tape by moving the instant invention slightly in a rearward direction (i.e., in a direction opposite to that in which the tape will ultimately be laid). This motion will tend to release the tape from the end of the tape holder 915. Then, when the user begins forward motion of the instant device 900, the terminus of the tape which is loosely held in the tape-end holder 915 by pin 1430 will be pulled lose, thereby freeing the tape applicator 900 to continue in a forward direction, depositing tape as it moves.

Those of ordinary skill in the art will recognize that the shape and number of notches in the notched member 1430 is unimportant to the operation of the instant invention. For example, the notches might be "V" shaped as illustrated or rounded, squared, etc. However, it is preferred that pin 1430 be placed within the notch, preferably at its lowest point, the notch thereby helping to guide the tape down onto the pin 1430. This will further help protect the user again contact with this typically-sharpened pin 1430 member. Thus, for purposes of the instant disclosure the term "notch" should be broadly construed to include any sort of indentation into or aperture through the member 1430. Additionally, it should be noted that the notched member 1430 and cutting member 1420 could be combined in a single member by sharpening the upper perimeter of notched member 1430. However, for safety reasons this would not be recommended, as the user could easily cut himself or herself on the then-exposed sharpened surface.

Although the instant invention is generally discussed as a vehicle for applying masking tape to a surface, those skilled in the art will realize that this invention could be used to apply others sorts of tape as well.

While the inventive device has been described and illustrated herein by reference to certain preferred embodiments in relation to the drawings attached hereto, various changes and further modifications, apart from those shown or suggested herein, may be made therein by those skilled in the art, without departing from the spirit of the inventive concept, the scope of which is to be determined by the following claims.

What is claimed is:

1. A hand held device for the application of adhesive tape from a roll onto a substantially planar surface, comprising:

(a) a body;

(b) a tape reel rotatably mounted on said body for dispensing the adhesive tape from the roll, said tape reel being sized to accommodate the roll of adhesive tape;

(c) a reel brake mounted on said body, said reel brake positionable to retard rotation of said tape reel when actuated;

(d) an application roller mounted on said body, said application roller for receiving adhesive tape from the roll and placing the adhesive tape in contact the substantially planar surface;

(e) a guide pin mounted on said body between said roll of adhesive tape and said application roller, said guide pin being positionable to be in continuous contact with the adhesive tape and for guiding said adhesive tape between said tape reel and said application roller; and, (f) a handle mounted on said body on a side opposite from said tape reel.

2. A device according to claim 1, wherein said reel brake frictionally engages said tape reel, thereby retarding its rotation.

3. A device according to claim 1, wherein said tape reel has a rearward face, said rearward face of said tape reel having at least one indentation therein, and wherein said reel brake comprises:

(c1) a brake rod, said brake rod being positionable to engage said at least one indentation of said tape reel rearward face, thereby retarding its rotation, and, (c2) an actuator, said actuator being operable by a user to urge said brake rod forward to engage said at least one indentation.

4. A device according to claim 1, further comprising:

(g) a cutter mounted on said body between said tape reel and said guide pin, said cutter being proximate to the adhesive tape when the adhesive tape is extended between said tape reel and said guide pin.

5. A device according to claim 4, wherein said cutter is positioned between said guide pin and said tape reel, and wherein said cutter engages and cuts the adhesive tape when said adhesive tape between said guide pin and said tape reel is placed under tension by engagement of said reel brake.

6. A device according to claim 1, further comprising:

(g) a tape-end holder mounted on said body on a side opposite from said guide pin, said tape-end holder for holding a terminus of the roll of adhesive tape.

7. A device according to claim 6, wherein said tape-end holder comprises:

(g1) a receiving member having an upper surface, (g2) at least one piercing pin mounted on said upper surface of said receiving member, and, (g3) a cutting member proximate to said at least one piercing pin, said cutting member being operable in conjunction with said at least one piercing pin to cut the tape.

8. A device according to claim 7, wherein said receiving member contains at least one notch therein, and wherein at least one of said at least one notches has a piercing pin positioned therein.

9. A method of severing adhesive tape that is dispensed from a roll onto a surface, wherein is provided the apparatus of claim 5, comprising the steps of:

(a) mounting the roll of adhesive tape on the tape reel;

(b) threading the adhesive tape over said guide pin and under said application roller;

(c) placing said application roller in contact with the surface;

(d) moving said device so as to rotate said application roller and deposit adhesive tape onto the surface;

(e) actuating said reel brake and continuing to move said device so as to rotate said application roller, thereby placing said adhesive tape between said guide pin and said tape reel under tension and severing said adhesive tape with said cutter.

10. A device for the application of adhesive tape from a roll onto a surface, comprising:

(a) a body;

(b) a tape reel rotatably mounted on said body for dispensing the adhesive tape from the roll, said tape reel being sized to accommodate the roll of adhesive tape;

(c) a reel brake mounted on said body, said reel brake positionable to retard rotation of said tape reel when actuated;

(d) an application roller mounted on said body, said application roller for receiving adhesive tape from the roll and placing the adhesive tape in contact the surface;

(e) a guide pin mounted on said body between said roll of adhesive tape and said application roller, said guide pin being positionable to be in continuous contact with the adhesive tape and for guiding said adhesive tape between said tape reel and said application roller; and, (f) a cutter mounted on said body between said tape reel and said guide pin, said cutter being proximate to the adhesive tape when the adhesive tape is extended between said tape reel and said guide pin, and said cutter engaging and cutting said adhesive tape when said adhesive tape between said guide pin and said tape reel is placed under tension by engagement of said reel brake.

11. A device for the application of adhesive tape from a roll onto a first surface abutting a second surface, said second surface being substantially transverse to said first surface, comprising:

(a) a body;

(b) a tape reel rotatably mounted on said body for dispensing the adhesive tape from the roll, said tape reel being sized to accommodate the roll of adhesive tape;

(c) an application roller mounted on said body, said application roller for receiving adhesive tape from the roll and placing the adhesive tape in contact with the first surface;

(d) a guide pin mounted on said body between said roll of adhesive tape and said application roller, said guide pin being positionable to be in continuous contact with the adhesive tape and for guiding said adhesive tape between said tape reel and said application roller; and, (e) a cutter mounted on said body between said tape reel and said guide pin, said cutter being proximate to the adhesive tape when the adhesive tape is extended between said tape reel and said guide pin, and said cutter engaging and cutting said adhesive tape when said adhesive tape between said guide pin and said tape reel is placed under tension; and, (f) a plurality of guide rollers mounted on said body, each of said guide rollers being oriented transversely to said application rollers, and, said guide rollers for completely supporting said device away from the second surface.

12. A device according to claim 11 wherein there are three guide rollers.

13. A device according to claim 11, further comprising:

(g) a reel brake mounted on said body, said reel brake positionable to retard rotation of said tape reel when actuated.

14. A device according to claim 11, further comprising:

(g) a tape-end holder mounted on said body on a side opposite from said guide pin, said tape-end holder for holding a terminus of the roll of adhesive tape.

15. A device according to claim 14, wherein said tape-end holder comprises:

(g1) a receiving member having an upper surface, (g2) at least one piercing pin mounted on said upper surface of said receiving member, and, (g3) a cutting member proximate to said at least one piercing pin, said cutting member being operable in conjunction with said at least one piercing pin to cut the tape.

16. A device according to claim 15, wherein said receiving member contains at least one notch therein, and wherein at least one of said at least one notches has a piercing pin positioned therein.

17. A device according to claim 15 wherein said guide rollers are adjustable to vary said predetermined distance from the second surface.

18. A device according to claim 17 wherein said guide rollers are affixed to a mounting plate, said mounting plate being mounted on said body, and said mounting plate being laterally movable to vary a position of said guide rollers with respect to said body, thereby varying said predetermined distance form the second surface.

19. A device according to claim 11, wherein said guide rollers maintain said body at a predetermined distance from the second surface.

* * * * *